US006113246A

United States Patent [19]

Ruh

[11] Patent Number: 6,113,246

[45] Date of Patent: Sep. 5, 2000

[54] NEON LIGHTING PROTECTING MOUNTING DEVICE

[76] Inventor: Anthony Ruh, 4741 N. Western Ave., Chicago, Ill. 60625

[21] Appl. No.: 08/953,267

[22] Filed: Oct. 17, 1997

Related U.S. Application Data

[63] Continuation of application No. 08/258,469, Jun. 10, 1994, abandoned.

[51] Int. Cl.[7] ..... F21V 15/00

[52] U.S. Cl. ..... 362/223; 362/377

[58] Field of Search ..... 362/223, 109, 362/374, 376, 224, 263, 216, 377; 248/50

[56] References Cited

U.S. PATENT DOCUMENTS

| | | | |
|---|---|---|---|
| 4,654,765 | 3/1987 | Laidman | 362/238 |
| 4,947,301 | 8/1990 | Steele | 362/219 |
| 5,001,613 | 3/1991 | Foster et al. | 362/223 |
| 5,008,787 | 4/1991 | Sklar | 362/221 |
| 5,142,461 | 8/1992 | Nugent | 362/252 |
| 5,142,466 | 8/1992 | Foster et al. | 362/368 |
| 5,188,448 | 2/1993 | Sinani et al. | 362/109 |
| 5,339,230 | 8/1994 | Devorris | 362/216 |

FOREIGN PATENT DOCUMENTS

| | | | |
|---|---|---|---|
| 473036 | 8/1975 | U.S.S.R. | 362/267 |
| 698220 | 10/1953 | United Kingdom | 362/223 |

*Primary Examiner*—Laura K. Tso

*Attorney, Agent, or Firm*—JoAnne M Denison; Denison & Assocs PC

[57] ABSTRACT

A novel neon lighting protective mounting device comprised of a transparent elongated elastomeric tubing or sleeve having two parallel interior channels which are able to seat both the central light emitting portion of a neon border light as well as the terminal blackened bent portions of a neon border light. The protective tube further has a flat surface extending its length which allows maximum illumination of the central light emitting portion of the neon border light through the transparent tube and which also allows the protective tubing to be removably mounted to the interior surface of a store window by using Velcro strips, screw and eyelet mounts or other type of attachment device.

3 Claims, 1 Drawing Sheet

NEON LIGHTING PROTECTING MOUNTING DEVICE

This application is a continuation of application Ser. No. 08/258,469, filed Jun. 10, 1994, now abandoned.

BACKGROUND OF THE INVENTION

The present invention relates to the area of devices which protect neon border lights. Neon border lights are frequently damaged or destroyed due to their location in relatively high traffic display windows. As display windows, retail and otherwise, are removed and updated or as maintenance persons access the area around the neon border lights, the resultant damage and destruction to the neon border lights requires repair and/or replacement of the neon border lights with significant, but unnecessary, attendant costs to the owner of the display borders.

Previous solutions which addressed the problems concerning the rigidity of neon or fluorescent light structures and the dangers and costs generated by their destruction have included complex encasement devices such as plastic coatings or sleeves, or structurally inappropriate mounting accessories which were not originally developed to protect an entire length of a neon border light.

In U.S. Pat. No. 3,576,304 granted to Gillemot on Apr. 27, 1971, a mounting accessory is disclosed for securing and detachably mounting flexible cable, i.e. interior telephone cables. The accessory comprises C-clips made from resilient elastomeric material, sized to receive and grip cables provides deep V-notches within the lateral walls of the C-clip to facilitate insertion and flexing of the C-clip. The C-clips have a planar surface posteriorly located from the C-clip opening and utilize interlocking barb and fiber separable strips. The '304 patent does not disclose a mounting accessory intended to run the length of the mounted item, addresses concerns more appropriate to flexible telephone cables than to rigid neon tubing and has the distinctive structural profile of a C-clip with V-notches.

In U.S. Pat. No. 4,924,368 granted to Northrup on May 28, 1990, a protective containment sleeve for a fluorescent lamp is disclosed in which the sleeve is attached to the circumference of the end of a fluorescent tube by adhesive and completely encases the lamp providing a sleeve to withstand mechanical stresses to the fluorescent lamp and to protectively contain a damaged fluorescent lamp should it explode. The approach of the '368 patent is to protect against minimal mechanical stresses to the lamp and to contain an exploded lamp after it has been destroyed. The present invention has a preventative focus in that it allows for easy removal of the protected light thus avoiding much of the dangers associated with display changes or display maintenance while still allowing for the protective and containment features of other devices.

SUMMARY OF THE INVENTION

The present invention is directed to devices which are capable of mounting and protecting elongate lighting devices and more particularly, neon lighting for store window borders. The focus of the present invention is to provide an easy and cost effective method for detachably mounting a neon light border while incorporating the aspects of protecting the light from mechanical stresses and providing for the safe containment of a damaged light.

The invention is comprised of a transparent elongate protective tube having two parallel interior channels with cross sectional areas which are adapted to fit the light emitting and terminal bent end portions of a neon border light. In one embodiment of the present invention, the center of the light emitting tube is placed in a channel close to the window, while the bent blackened (non-light emitting portion) ends are placed in a channel away from the window. As a variation, both the center of the light emitting tube and the bent blackened (non-light emitting portion) ends may run next to the window in two parallel channels. In a preferred embodiment, the protective tubing is constructed from flexible, yet semi-rigid polymers. The protective elastomeric tubing has an elongated planar mounting surface which may be used for attaching hook and loop type fastener strips, commonly referred to as Velcro brand fasteners, or for utilizing any other type of mounting apparatus, such as a screw and eyelet system. The planar mounting surface also allows for a maximum transmittal of light due to the proximity to the channel which seats the light emitting portion of the neon border light to the window upon which the light will be mounted. Upon inserting a neon border light into the protective tubing, the entire assembly can then be secured to the interior of a window surface. Thus, the entire neon border light is thereby protected as it can be easily removed or quickly reattached to any store window. It also entirely surrounds and protects a neon border light from bumps and abuse occurring during cleaning or display work which can otherwise cause severe damage or destruction to a neon border light. Further, in the event of breakage of the neon border light this invention provides for a safe containment of the broken light thus reducing the dangers involved during or after that sort of mishap.

OBJECTS OF THE INVENTION

It is therefore an object of the invention to provide a cost efficient and easy to use protective mounting device for neon light borders.

A further object of the invention is to provide the easy removal and reinstallation of the protectively mounted neon light border for access to the display area by personnel changing the display or providing maintenance to the display area.

Another object of the invention is to reduce the damage or destruction of lighting structures in display areas.

Yet another object of the invention is provide a protective mounting device running the entire length of a neon border light structure.

A still further object of the invention is to provide for the safe containment of a damaged light structure.

A further object of the present invention is to provide a protective mounting device which can use a variety of fasteners to attach the mounting device to a window or window frame, such as Velcro, plastic tang rivets, screws, etc., that are all simple and inexpensive to use.

Still another object of the invention is to prevent transmittal of externally applied mechanical stresses to the light structure resulting in damage or destruction.

BRIEF DESCRIPTION OF THE DRAWINGS

Other objects and advantages of the present invention will become more apparent upon reference to the following specification and annexed drawings in which.

DESCRIPTION OF THE PREFERRED EMBODIMENT

Figure 1:
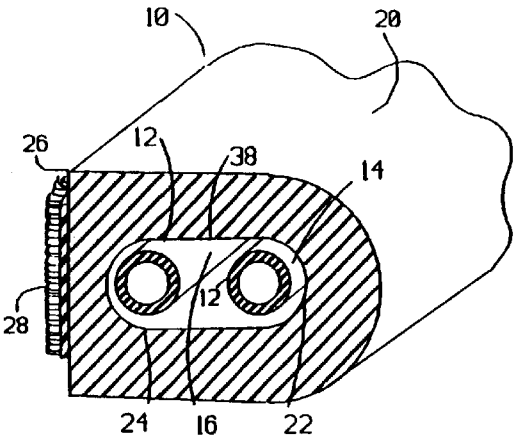
FIG. 1 is a cross sectional cut away perspective view of line 1—1 of FIG. 4 of a preferred embodiment of the invention.

Referring to the drawings in detail, FIG. 1 shows a neon lighting protective mounting device 10 comprising a transparent elongate tube 20 containing an interior chamber 38. The interior chamber 38 includes a first parallel interior channel 22 and a second parallel interior channel 24. The interior chamber 38 houses an elongate light emitting device 12. The elongate light emitting device 12 includes a central light emitting portion 14, a first terminal portion 16, and a second terminal portion 18 (shown in FIG. 4). The central light emitting portion 14 rests in the first parallel interior channel 22, and the first terminal portion 16 and second terminal portion 18 (shown in FIG. 4) rest in the second parallel interior channel 24. The transparent elongate tube 20 incorporates an elongate planar mounting surface 26. In this preferred embodiment of the invention, a hook or loop type fastener strip 28, commonly known as VELCRO®, is attached to the elongate planar mounting surface 26.

Figure 2:
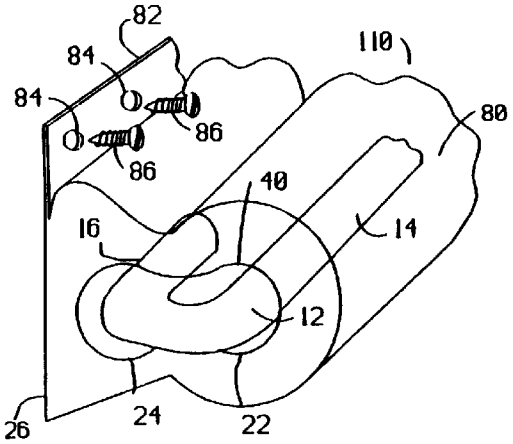
FIG. 2 is an end perspective cut away view of a second preferred embodiment of the protective mounting device showing a neon light border tube being inserted lengthwise.

In this preferred embodiment of the invention, the transparent elongate tube 20 is constructed as a unitary, extruded material. Suitable materials must be flexible, semi-rigid, resilient, relatively impervious to the degrading effects of heat and ultraviolet radiation and have appropriate light transmitting qualities for effective transparency. Suitable materials include, but are not limited to, polyvinyl resins and nylon. The external structure of the transparent elongate tube 20 in this preferred embodiment is "D" shaped in cross-section as shown in FIG. 1 and is "keyhole" shaped in cross-section as shown in FIG. 2; however, the invention is known to include a range of cross-sectional configurations in other preferred embodiments. The invention may also consist of tubing of various appropriate lengths.

In one preferred embodiment of the invention, the interior chamber 38 is shaped like an ellipse as shown in cross-section in FIG. 1. The combination of the first parallel interior channel 22 and the second parallel interior channel 24 comprises a spatial majority of the interior chamber 38 in the elliptical embodiment of the invention as shown in FIG. 1. In another embodiment of the invention, the interior chamber 40 is shaped like a pinched ellipse as shown in cross section in FIG. 2. Here again the first parallel interior channel 22 and the second parallel interior channel 24 comprise a spatial majority of the interior chamber 40.

Referring back to FIG. 1, the first parallel interior channel 22 accepts the central light emitting portion 14 of the elongate light emitting device 12 and seats the same upon insertion of the elongate light emitting device 12 into the interior chamber 38. The central light emitting portion 14 of the elongate light emitting device 12 is the portion responsible for emitting light. In a preferred embodiment, the first parallel interior channel 22 is distal to the elongated planar mounting surface 26 such that upon insertion and seating of the central light emitting portion 14 of the elongate light emitting device 12, there is relatively little distance from the elongate light emitting device 12 to a store window, allowing for maximum illumination by the light emitting device 12.

FIG. 2 shows the neon lighting protective mounting device 110 which shows the elongate light emitting device 12 being slidably inserted therein. FIG. 2 also demonstrates how the second parallel interior channel 24 accepts the first terminal portion 16 of the elongate light emitting device 12 and seats the same upon the insertion described above. The first terminal portion 16 of the elongate light emitting device 12 is a non-illuminating portion of the elongate light emitting device 12 and is generally painted or coated black. Upon complete insertion of the elongate light emitting device 12 into the transparent elongate tube 80, the first terminal portion 16 of the elongate light emitting device 12 becomes protectively encased within the second parallel interior channel 24. Structurally, the first parallel interior channel 22 is located proximal to a store window to provide maximum light transmission.

Figure 3:
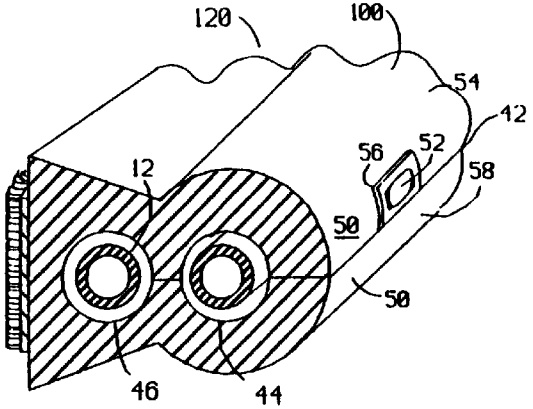
FIG. 3 is a cross sectional cut away perspective view of a third preferred embodiment of the invention.

FIG. 3 shows neon lighting protective mounting device 120. The parallel interior channels 22 and 24 of the previous preferred embodiment become separate channels 44 and 46 and are intersected by a fissure 42. The fissure 42 extends perpendicularly across the transparent elongate tube 100. The fissure 42 extends from a distal exterior surface 50 through the first and second parallel interior channels, 44 and 46, and up to but not including the elongated planar mounting surface 26. This embodiment of the invention has the advantages of more securely seating and separating the central light emitting portion 14 of the elongate light emitting device 12 from the first terminal portion 16 and second terminal portion 18 of the elongate light emitting device 12. This embodiment further allows the invention to be used with elongate light emitting devices 12 where lengthwise insertion of a elongate light emitting device 12 into the protective mounting device 10 is not feasible. The fissure 42 is separable, providing for a jaw-like opening of the transparent elongate tube 100 to expose both parallel interior channels 44 and 46. In this position, the central light emitting portion 14 and the terminal portions 16 and 18 of the elongate light emitting device 12 can be seated directly into the first and second interior channels, 44 and 46. Closure of the transparent elongate tube 100 is achieved by allowing the transparent elongate tube 100 to elastically resume its original shape. The transparent elongate tube 100 may further be secured into the closed position by a first closure element 52 removably engaging a second closure element 56. The first closure element 52 is located on the first marginal portion 54 of the distal exterior surface 50, and the second closure element 56 is located on the second marginal portion 58 of the distal exterior surface 50.

Figure 4:
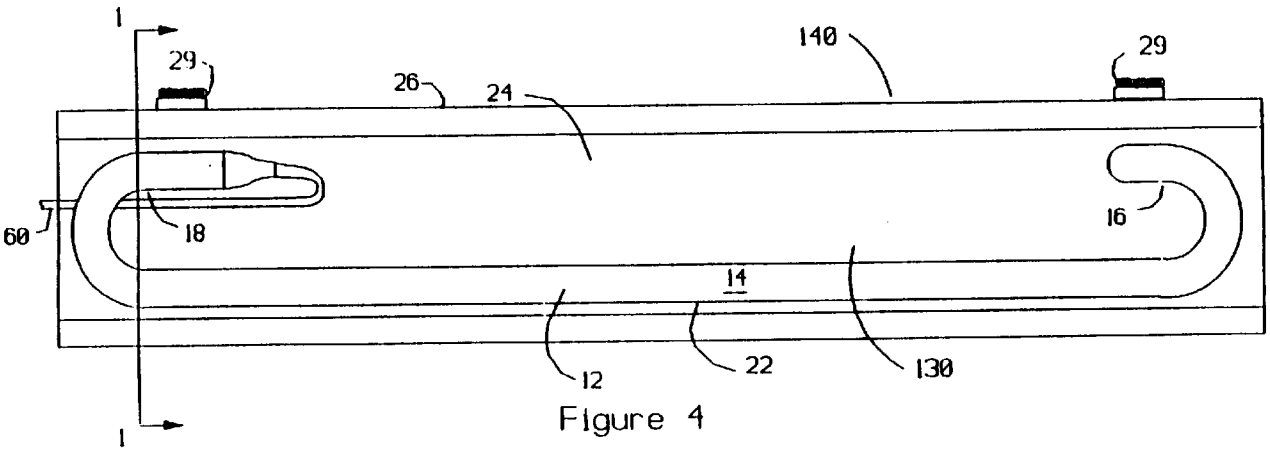
FIG. 4 is a top view of a protective mounting device shown containing an elongate neon light emitting device.

In another preferred embodiment of the invention, once the elongate light emitting device 12 is inserted or seated into the protective mounting device 10, the now protected elongate light emitting device 12 may be mounted in any place desirable to have an elongate light emitting device 12 by attaching any means of fastening the protected elongate light emitting device 12 to an elongate planar mounting surface 26. Although a variety of mounting methods are contemplated for this purpose, including adhesives, clips or hooks, and screws, a preferred embodiment utilizes hook or loop type fastener strips 28 as shown in FIGS. 1, 3, and 4. Hook strops 28 are shown in FIGS. 1 and 3, while the corresponding loop strips 29 are shown in FIG. 4, A hook or loop type fastener strip is preferred because hook or loop type fastener strips allow for the easy detachable mounting and securing of the protected elongate light emitting device 12 whereas other mounting devices and schemes are not easily detachable. Further, other mounting devices tend to be permanent and may damage the elongate planar mounting surface 26. In the preferred embodiment shown in FIGS. 1 and 3, a first hook strip 28 is attached to the elongate planar mounting surface 26 of the transparent elongate tube 20 and a corresponding loop strip is anchored to an external mounting surface such as the interior glass or frame of a store window.

FIG. 2 also shows a preferred embodiment of the invention where the elongate planar mounting surface 26 can be extended beyond the edge of the transparent elongate tube 80, becoming mounting flange 82. The mounting flange 82 is provided with a plurality of apertures 84. Screws 86 may be driven through apertures 84 into a nearby window frame, wall, etc. to secure the neon lighting protective mounting device 110. In this fashion, the neon lighting protective mounting device 110 may be attached to a fixed surface permanently through the use of screws, nails, bolts, etc. The neon lighting protective mounting device 110 could be fixed to a horizontal window frame or wall ledge so that the first and second parallel channels 22 and 24, as shown in the embodiment of FIG. 2, or 44 and 46, as shown in the embodiment of FIG. 3, are aligned parallel to the window pane, wall, etc. Likewise, the neon lighting protective mounting device 110 could be fixed to a vertical surface so the parallel channels 22 and 24, or 44 and 46 are aligned perpendicular to a window surface or wall, ceiling, etc.

FIG. 4 shows one preferred embodiment of the neon lighting protective mounting device 140 in top view, although other preferred embodiments could similarly be used. The elongate light emitting device 12 is secured within the within the transparent elongate tube 130. The loop type fasteners 29 can be seen attached to the elongate planar mounting surface 26. An electrical connecting line 60 extends from the elongate light emitting device 12 and runs along a length of the second parallel interior channel 24 or 46, typically exiting to engage with a transformer connected to an electrical power source (not shown).

While the invention has been described in connection with preferred embodiments, it will be understood by those skilled in the art that various changes and modifications may be made therein without departing from the spirit or scope of the invention and all reasonable equivalents are intended to be covered by the appended claims.

What is claimed:

1. A protective mounting device for elongate light emitting devices which have a central light emitting portion and terminal portions at either end comprising;

a transparent elongate tube constructed of rigid or semi-rigid flexible translucent polymers;

a first of two parallel interior channels extending through the transparent tube which is adapted to fit and seat the central light emitting portion of the light emitting device; and, a second of two parallel interior channels extending through the transparent elongate tube which is adapted to fit and seat the terminal portion of the elongate light emitting device;

the first and second parallel interior channels creating a cross section wherein the channels are in open communication with one another; and, a substantially planar elongate mounting surface and a mounting flange depending from the substantially planar elongate mounting surface.

2. The device of claim 1 in which the mounting flange has been provided with at least securement means which allows the protective mounting device to be removably secured to a structure.

3. The device of claim 2 in which the mounting flange has been provided with a plurality of apertures which are adapted to fit a plurality of corresponding fastening elements.

* * * * *